US007446744B2

(12) United States Patent
Klein et al.

(10) Patent No.: US 7,446,744 B2
(45) Date of Patent: Nov. 4, 2008

(54) DISPLAY DEVICE WITH PRE-CHARGING ARRANGEMENT

(75) Inventors: Markus Heinrich Klein, Heerlen (NL); Douwe Thomas De Jong, Heerlen (NL); Serge Leon Gerard Toussaint, Heerlen (NL); Adrianus Sempel, Eindhoven (NL); Remco Los, Arequipa (PE); Pieter Jacob Snijder, Eindhoven (NL); Olaf Gielkens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 520 days.

(21) Appl. No.: 10/534,484

(22) PCT Filed: Nov. 4, 2003

(86) PCT No.: PCT/IB03/04999

§ 371 (c)(1),
(2), (4) Date: May 10, 2005

(87) PCT Pub. No.: WO2004/047065

PCT Pub. Date: Jun. 3, 2004

(65) Prior Publication Data

US 2006/0125744 A1 Jun. 15, 2006

(30) Foreign Application Priority Data

Nov. 15, 2002 (EP) ..... 02079770

(51) Int. Cl.
*G09G 3/32* (2006.01)

(52) U.S. Cl. ..... 345/87

(58) Field of Classification Search ..... 345/1.1, 345/1.2, 1.3, 207, 76–83
See application file for complete search history.

(56) References Cited

U.S. PATENT DOCUMENTS

| | | | | |
|---|---|---|---|---|
| 5,552,677 | A | 9/1996 | Pagones | |
| 5,723,950 | A * | 3/1998 | Wei et al. | 315/169.3 |
| 6,369,781 | B2 | 4/2002 | Hashimoto et al. | |
| 6,369,786 | B1 | 4/2002 | Suzuki | |
| 7,019,720 | B2 * | 3/2006 | LeChevalier | 345/82 |

(Continued)

FOREIGN PATENT DOCUMENTS

EP 1 164 567 A2 12/2001

(Continued)

OTHER PUBLICATIONS

Patent Abstracts of Japan, Pub. No.: 10-153984, Date: Jun. 9, 1998.

*Primary Examiner*—Richard Hjerpe
*Assistant Examiner*—Shaheda A Abdin

(57) ABSTRACT

The invention relates to a display device comprising a plurality of light emitting elements (1), wherein at least one of the elements has an associated capacitor (C1). The display device comprises pre-charging means (7;8) for generating a pre-charge signal for charging the associated capacitor (C1) at least partly. The pre-charging means (7;8) are adapted for generating a pre-charge signal comprising at least a first pre-charge signal in a first pre-charge stage and a second pre-charge signal in a second pre-charge stage. The pre-charge signal preferably comprises a current pre-charge signal followed by a voltage pre-charge signal. The combined pre-charge signal has the advantage of fast, but accurate pre-charging.

14 Claims, 6 Drawing Sheets

U.S. PATENT DOCUMENTS

2002/0036605 A1* 3/2002 Kawashima ..... 345/76

FOREIGN PATENT DOCUMENTS

EP 1164567 A2 12/2001
EP 1164567 B1 12/2001
EP 1282104 A 2/2003
JP 10153984 6/1998
WO WO03098974 A1 11/2003

* cited by examiner

DISPLAY DEVICE WITH PRE-CHARGING ARRANGEMENT

The invention relates to a display device comprising a plurality of light emitting elements, at least one of the elements having an associated capacitor, the device comprising pre-charging means for generating a pre-charge signal for charging the associated capacitor at least partly.

In more and more display applications, light emitting matrix displays, such as organic light emitting displays or inorganic light emitting displays, are used. The basic device structure of a light emitting matrix display essentially comprises a structured electrode or anode, a counter electrode or cathode and a light emitting layer, sandwiched between the anode and the cathode. In a passive matrix display the anode may comprise a set of separate parallel anode strips, also referred to as anode columns (or anode rows depending on their direction), each being adapted to be connected to a current or voltage source. Further, the cathode may comprise a set of separate parallel cathode strips, also referred to as cathode rows (or cathode columns depending on their direction), their direction usually being essentially perpendicular to the anode strips or columns. The point of intersection of such an anode and cathode essentially defines a pixel or light emitting element of said display device, and said pattern of anodes and cathodes hence defines a matrix of pixels. An electrical representation of such a passive matrix display is provided in FIG. 1. Light emitting elements are indicated as diodes 1. Such a passive matrix display may be addressed line by line, by applying subsequent pulses, here indicated as signals 3, to subsequent lines 2. The lines are indicated by means of reference numeral 2 in FIG. 1 and are here represented as a common cathode, the cathodes being selected one by one together with all anodes in a column 4. The anodes are supplied with a current (signals 5) of an energy corresponding to the grey value required. Grey values are usually obtained by setting the amplitude of the current or the on-time of the current source according to the conditions required.

The light emitting elements may be driven by a voltage or by a current. Current driven matrix displays, wherein a forward current is drawn through the light emitting element 1, have several advantages. The main advantage of current driving of such a matrix display is a good grey scale control. A light emitting element 1 will essentially generate light when a forward current is drawn through the light emitting layer, the current being applied by said anode/cathode pattern via columns 4. The light originates from electron/hole pairs recombining in the active area, with the excess energy partly being emitted as photons, i.e. light. The number of photons generated (i.e. the brightness of the pixel) depends on the number of electrons/holes injected in the active area, that is the current flowing through the pixel.

A disadvantage of current driving is that an additional pre-charge driver is needed to charge parasitic capacitors present in the display matrix device. FIG. 2 shows an equivalent circuit for a passive matrix display. The display is current driven by current sources 6. Line or row selection is obtained from voltage sources 7. As illustrated by the black coloured diodes 1, these diodes are selected by the voltage source 7 by applying a low voltage, for example, a ground level voltage to the selected row; to the other rows a high voltage, indicated by means of +, is applied which effectively blocks all diodes attached to the other rows. The black colored diodes 1 are driven by the respective current source 6, i.e. the light emitting element 1 generates light. It is well known that e.g. a light emitting element such as a diode 1 has an associated capacitor C1, resulting e.g. from a parasitic capacitance caused by the sandwich structure referred to above and/or from the connection leads within and outside the display device. This associated capacitor has to be charged. Moreover, associated resistances R may be present, originating from the anode and cathode structures and connections in the display device.

U.S. Pat. No. 5,723,950 discloses a pre-charge driver for light emitting devices with an associated capacitance. A square wave of current for driving the light emitting device is initially applied together with a sharp current pulse to rapidly charge the associated capacitor of the light emitting device. Such an approach is colloquially referred to as current boosting, which expression is used in the present text as an equivalent for current pre-charging.

However, current boosting, although successful in rapidly pre-charging the associated capacitor, has some drawbacks. These drawbacks relate, amongst other things, to inflexibility, inaccuracy and/or cost-ineffectiveness if current boosting according to the prior art is applied.

It is an object of the invention to provide a display device with improved pre-charging means. The invention is defined by the independent claims. The dependent claims define advantageous embodiments.

The object is achieved by providing a display device characterised in that said pre-charging means are adapted for generating said pre-charge signal comprising at least a first pre-charge signal in a first pre-charge stage and a second pre-charge signal in a second pre-charge stage. By dividing the pre-charge stage into several sub-stages (i.e. the first, second and further pre-charge stages), a higher degree of flexibility of the pre-charging of the associated capacitor can be achieved, since it becomes possible to provide a pre-charging signal satisfying several different pre-charging criteria during pre-charging. These pre-charging criteria may refer to accuracy in the resulting signals and/or to the time wherein pre-charging of an associated capacitor is achieved.

It should be appreciated that the invention applies to all display devices wherein an associated capacitor is to be charged. Besides the current driven passive matrix displays, small molecule or polymer organic LED displays, inorganic displays, electroluminescence displays, field emission displays, also active-addressed displays and liquid crystal displays (LCD's) may benefit from a pre-charging arrangement as disclosed. The method proposed here can be advantageously used in displays where a fast preset is required while keeping the charging currents limited. As the dimensions of the display pixels need not be fixed, the method can be used as well for driving segmented displays. Below an example for a current driven passive matrix display will be discussed in detail.

In an embodiment of the invention the pre-charging means comprise a current source for generating a current pre-charge signal during said first pre-charge stage and a voltage source for generating a subsequent voltage pre-charge signal during said second pre-charge stage. This embodiment of combined boosting has the advantage that the rapid charging of the current boosting approach is combined with the less rapid, but much more accurate, subsequent voltage boosting. First the associated capacitor is pre-charged to roughly the operating voltage of the light emitting element and subsequently a pre-charge voltage is applied that may accurately approach the operating voltage, which is the voltage needed to drive the display diode(s) at the required luminance level. Moreover, the current boost has to be less accurate in comparison with pure current boosting, since a more accurate pre-charge signal is applied afterwards by a voltage boost. Therefore, the means for applying the current pre-charge signal have to fulfil less severe requirements as a consequence of which the current boost source can be implemented in the display device more easily and less costly.

In an embodiment of the invention the pre-charge current is limited. High pre-charge currents may cause interference in the display device, as a result of which light emitting elements that are not driven may generate light. Moreover high pre-charge currents may cause high voltage drops across parasitic resistances, drawn as resistances R in FIG. 2, in the display device. Limitation of the pre-charge current is preferably achieved by using a current source, which source may be connected to a voltage source adapted for selecting a light emitting element in a matrix of elements during operation. The latter arrangement provides the advantage of automatic saturation of the pre-charge current and easy implementation in the display device. The current may also be limited by a resistance or a combination of resistances that can be selected in order to obtain an appropriate pre-charge current. It should be appreciated that alternative current limiting elements, such as e.g. coils, may be used alternatively or additionally.

In an embodiment of the invention the pre-charging means comprises a voltage source in order to generate a voltage pre-charge signal via a first resistance during said first pre-charge stage and a subsequent voltage pre-charge signal via a second resistance during said second pre-charge stage. Such an approach may reduce the disadvantage of single voltage boosting and can be very easily implemented in the display device. Since an accurate current source is no longer needed, this approach is very cost-effective as well.

In an embodiment of the invention the pre-charging means is adapted to obtain the operating voltage of at least one light emitting element and to generate during the second pre-charge stage a pre-charge voltage signal in accordance with said operating voltage. This embodiment provides the advantage that automatic adaptation is achieved for variations in capacitance of the associated capacitors and in the material of the light emitting elements. Variation may be due to ageing of the elements, and/or to the fact that the organic materials may have slightly different properties for different batches and/or to variations in layer thickness. Preferably, the operating voltage is obtained in a steady state of the light emitting element, i.e. near the end of the time during which the element is driven. Moreover, there is no need to set the pre-charge current amplitude and time for every brightness level as is the case for pure current pre-charging schemes. Further, a uniform brightness is obtained, especially at low grey levels, since the amount of charge required for generating these low grey levels is small compared to the charge charging the associated capacitor(s).

The invention also relates to an electroluminescent matrix pre-charging arrangement comprising the features with respect to the pre-charging signal and the pre-charging means as discussed above.

The invention also relates to an electronic device comprising such a display device and/or pre-charging arrangement. Such an electronic device may e.g. be a device such as a monitor and also a handheld device such as a mobile phone or a PDA. Also multiplexed segmented displays are advantageously driven according to the invention, especially when the dimensions or materials of the various segments are different.

U.S. Pat. No. 6,369,786 B1 discloses a matrix of display elements wherein voltage boosting is applied up to a threshold voltage. However, neither a preceding current boosting nor voltage boosting to the operating voltage is disclosed.

These and other aspect of the invention will be apparent from and described in more detail below with refrence to the attached drawings, in which.

Figure 3A:
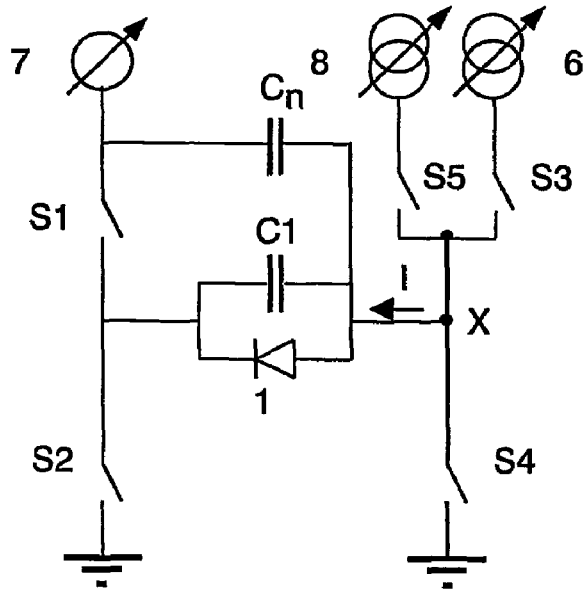
Figure 4A:
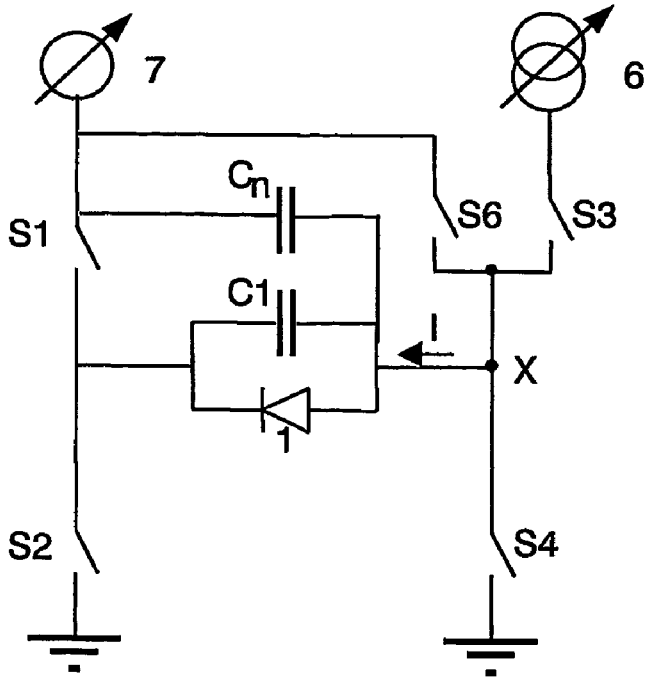
Figure 5A:
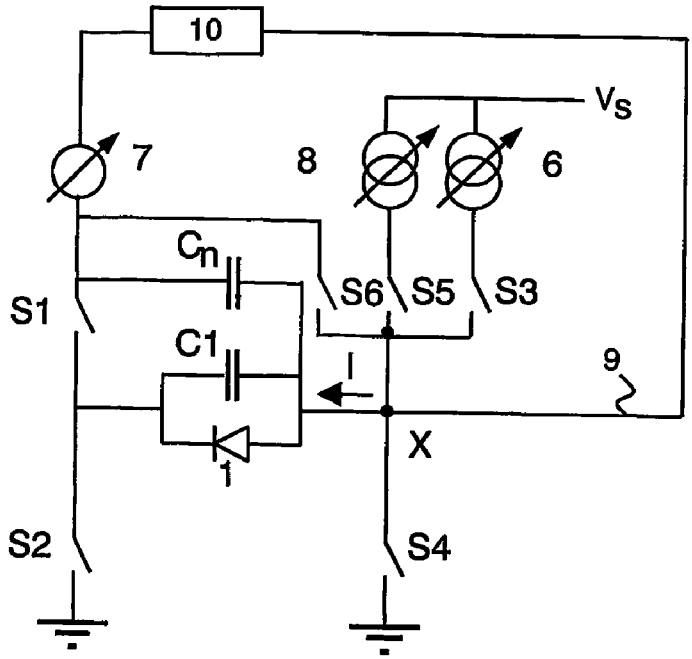
Figure 6A:
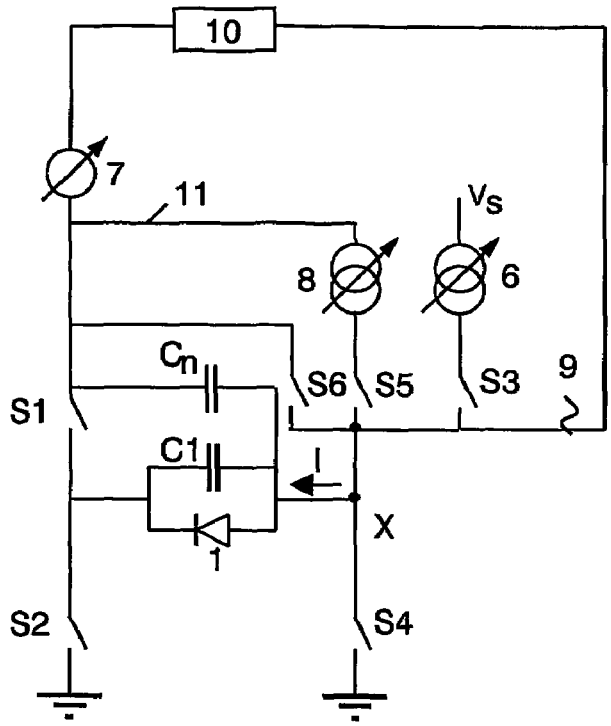
Figure 7A:
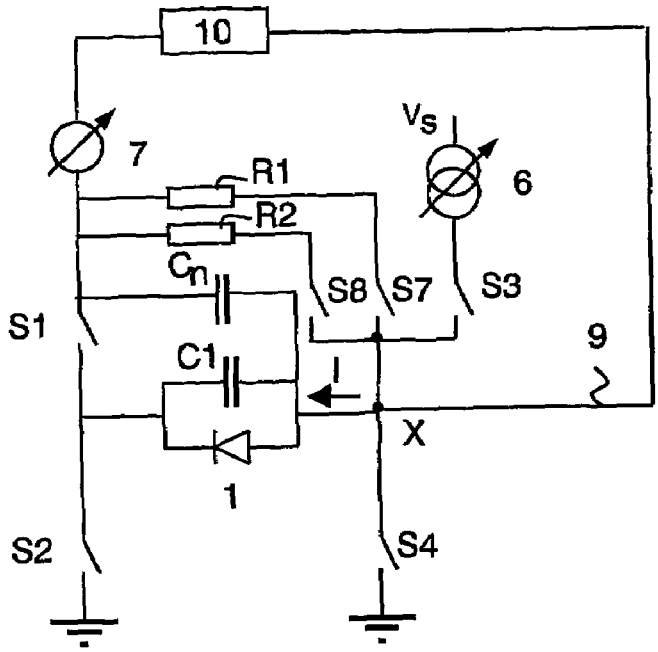

FIGS. 3A and B illustrate the conventional current boosting approach for a LED display;

FIGS. 4A and B illustrate the conventional voltage boosting approach for a LED display;

FIGS. 5A and B show a first embodiment according to the invention of combined current and voltage boosting;

FIGS. 6A and B show a second embodiment according to the invention of combined current and voltage boosting;

FIGS. 7A and B show a third embodiment according to the invention of voltage boosting in two stages.

For an adequate understanding of the embodiments of the invention, first the concepts of current boosting and voltage boosting will be briefly discussed.

Figure 1:
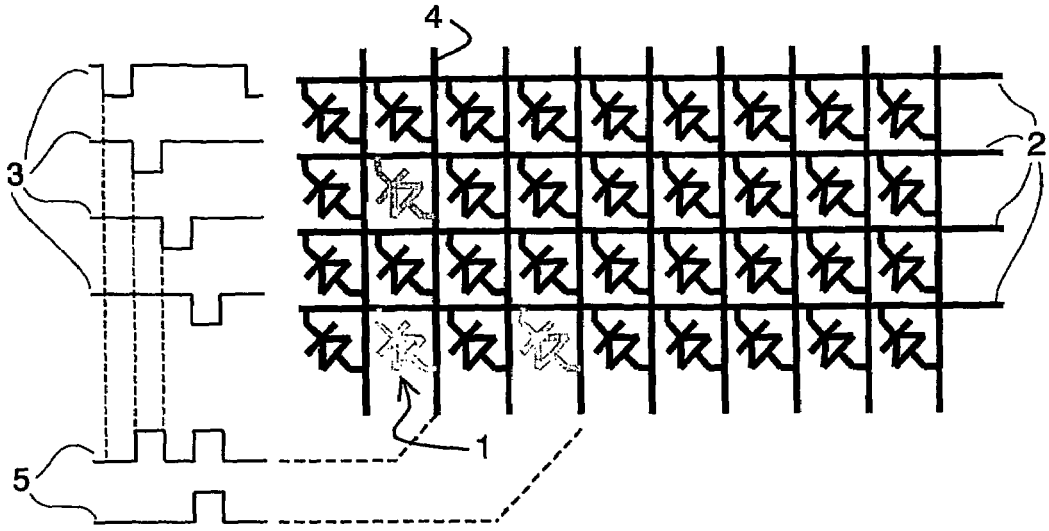
FIG. 1 shows a passive matrix organic LED display in a common cathode concept.
Figure 2:
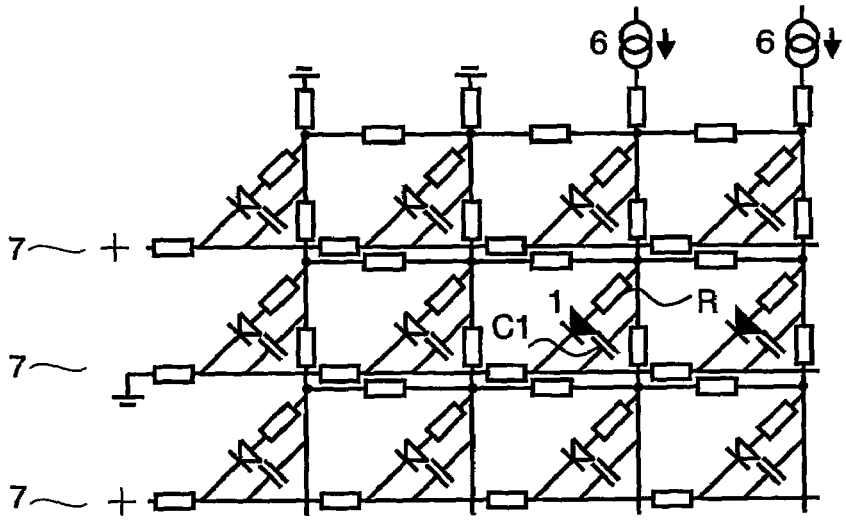
FIG. 2 shows an equivalent circuit for a part of the passive matrix display of FIG. 1.

FIG. 3A shows a single light emitting diode 1, hereinafter referred to as LED 1, which is part of a passive matrix display as depicted in FIG. 1. LED 1 is current driven by current source 6 and can be selected in the passive matrix by voltage source 7. A capacitance C1, directly associated with LED 1, is shown together with the capacitance $C_n$ representing all associated capacitors of the LEDs 1 in column 4 to be charged. For pre-charging the associated capacitors C1 and $C_n$, a current boost source 8 is provided. Moreover, the circuit exhibits switches S1, S2, S3, S4 and S5, for connecting the LED 1 to the current source 6, the voltage source 7 and the current boost source 8.

Figure 3B:
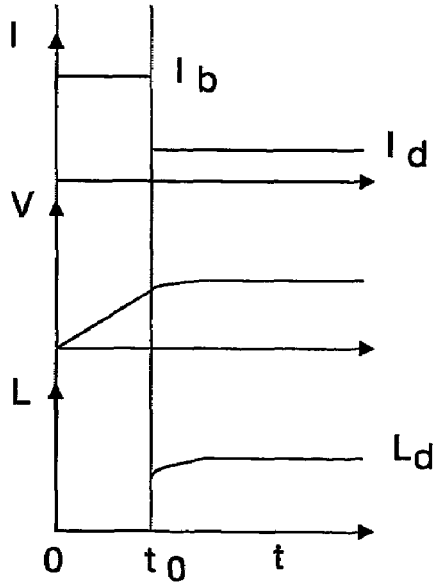

In FIG. 3B a current boost scheme is shown with respect to FIG. 3A. The graphs shown represent the current I as a function of time t, indicated in FIG. 3A, and the voltage V at point X. The bottom graph refers to the light L emitted by the LED 1. Suppose that LED 1 is required to generate light in the passive matrix display at time $t=t_0$. Since the associated capacitors C1 and $C_n$ are charged before a driving current $I_d$ flows through the LED 1, a current preceding the drive current is required to charge these associated capacitors. This current is typically provided as a boost current $I_b$. This boost current $I_b$ is obtained from the boost current source 8 at a suitable time t before $t_0$, for example, between t=0 and $t=t_0$. Boost current $I_b$ typically is significantly higher than the driving current $I_d$ for driving the LED 1 from the current source 6.

At t=0 switches S2, S3 and S4 are open, while S1 and S5 are closed. In this situation LED 1 is not selected and the current boost $I_b$ may charge up the associated capacitors C1 and $C_n$. The boost current $I_b$ is supposed to be the maximum allowed current, which can be set by programming the current amplitude and time. In this way the voltage V over the LED 1 can be boosted rapidly to a particular voltage level, which can be chosen close to the operating voltage. As the final voltage over the LED 1 generated by boosting is reached by programming the current amplitude and time, a non-optimal boost may result from any variation in the associated capacitors. This variation may e.g. be caused by layer thickness variations in the LED sandwich structure, material ageing, or properties of the interconnecting leads. The final voltage also depends on the timing and amplitude of the boost current $I_b$. As a result this final voltage is defined less accurately, and may even exceed the operating voltage, i.e. overshoot may occur.

At $t=t_0$ switch S1 is opened, i.e. LED 1 is selected in the passive matrix display. Moreover S4 and S5 are opened, while S2 and S3 are closed so as to drive the LED 1 from the current source 6 with the driving current $I_d$. As shown by way of example in FIG. 3B, the voltage V over the diode at $t=t_0$ is not accurate in that the operating voltage is not yet reached at that time and therefore the light L generated from the LED 1 is not yet at the required level $L_d$. Also some initial overshoot (not shown) may be present.

In conclusion, current boosting provides a fast, but inaccurate way to pre-charge the associated capacitors of a passive matrix display.

In FIG. 4A, a voltage boosting scheme is shown. Components equivalent to those depicted in FIG. 3A for the current boosting scheme are indicated by identical reference numbers. In this example, the voltage boost scheme applies the voltage source 7 for selecting a LED 1 of the passive matrix display as well as for the voltage boost, employing switch S6.

Figure 4B:
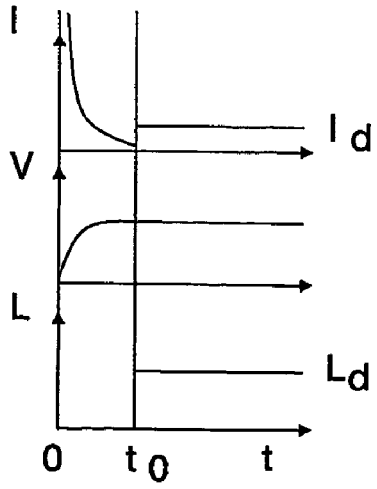

FIG. 4B shows a voltage boosting scheme to be executed by the circuit depicted in FIG. 4A. Just before time t=0, switch S4 may be closed to guarantee that all charge at point X has been removed, and no pixel content related cross-talk will occur, thereafter S4 is opened.

At time t=0 (when S1 and S6 are closed) the voltage of voltage source 7 is applied to LED 1, which theoretically results in an infinitely high current I. The final voltage across the LED 1 as result of the voltage boosting is accurately obtained before time $t=t_0$. At time $t=t_0$ S2 and S3 are closed and the light L emitted from the LED 1 the required level $L_d$ has from time $t=t_0$ onwards, as can be seen in FIG. 4B.

In a voltage boosted system, the final voltage is fixed by the required value of the voltage V across the LED 1, independent of the value of a series resistance in the current loop formed by the voltage source 7, the associated capacitors C1, Cn and their interconnections. A series resistance limits the current. The voltage source is not an ideal voltage source and further parasitic column and row resistances are present, resulting from the electrodes and the connections to these electrodes of the passive matrix display device. This resistance sets a minimum charging time, e.g. about 3 times the RC time constant, before the associated capacitors C1, Cn are properly charged. As the resistance can be large, a significant time delay can be the result of this. Thus, although the voltage obtained at $t=t_0$ is accurate, a time penalty is present in the voltage boosting scheme.

In conclusion, voltage boosting provides an accurate, but slow way to pre-charge the associated capacitors of a passive matrix display and large initial currents may flow.

FIG. 5A shows a boosting and driving circuit according to a first embodiment of the invention. In FIG. 5A components identical to those shown in FIG. 3A and FIG. 4A are indicated by identical reference signs.

Current source 6 can be connected to the anode of LED 1 via switch S3 to drive this LED 1. The anode can be further connected to ground potential via switch S4. A (low-ohmic) voltage source 7 is adapted to provide a potential to the cathode of LED 1 via switch S1 in order to select LED 1 in a passive matrix display. If S1 is closed, LED 1 is not selected and will not generate light. The cathode of LED 1 may be further connected to ground potential via switch S2. LED 1 further has an associated capacitor C1, in parallel with LED 1. Moreover an associated capacitor $C_n$ is present, parallel to LED 1, representing the associated capacitors of the n other light emitting elements in the same anode column 4 and the parasitic line capacitance. A current boost source 8 can be connected to the anode of LED 1 via switch S5. Current source 6 and current boost source 8 are supplied by a supply voltage $V_s$. Moreover voltage source 7 can be connected via switch S6 to the anode of LED 1. Finally via lead 9 and sensing unit 10, the voltage source 7 is enabled to sense or measure the potential of point X, i.e. the voltage applied over the LED 1 if S2 is closed.

Figure 5B:
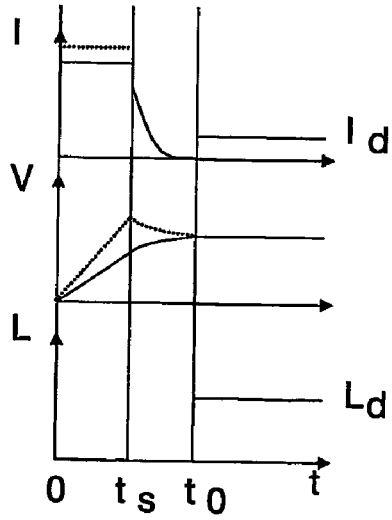

In FIG. 5B a boosting and driving scheme is depicted in order to illustrate the operation of the first embodiment according to the invention.

At time t=0, switches S1 and S5 are closed, i.e. the LED 1 is not selected in the passive matrix display and a boost current $I_b$ is applied via the current boost source 8 as a first pre-charge signal to charge up the associated capacitors C1 and $C_n$. The limits for $I_b$ are set by the requirements of avoiding cross-talk in the display device, while providing enough charge to charge up the associated capacitors. During this first stage, the voltage over the LED 1 is roughly and rapidly brought to a level near the operating voltage for the LED 1.

If this voltage is reached, a second boost stage is initiated at time $t=t_s$, closing switches S2 and S6, wherein a subsequent voltage boost is applied as a second pre-charge signal. During this second stage the voltage over the LED 1 is accurately brought to the operating voltage. The voltage supplied is preferably equal to the operating voltage in the steady state of LED 1, i.e. the state at the end of selection of the line by voltage source 7. During this second stage only very small currents are required to bring the voltage across the LED 1 to the level of the operating voltage. The voltage across the LED 1 can be sensed or measured via connection 9 and fed back to the voltage source 7. The sensing unit 10 of the LED voltage V enables an overshoot of the voltage over the diode during the first pre-charge stage, resulting from the rough current boost, to be corrected in the second pre-charge stage, as illustrated in FIG. 5B by the dashed line.

At time $t=t_0$, switches S2 and S3 are closed and the LED 1 is ready to receive the driving current Id and emit the required amount of light $L_d$. Preferably all the associated capacitors C1 and $C_n$ are charged up completely before LED 1 is selected by opening switch S1 and closing switch S2. Other switching sequences are possible, e.g. selecting LED 1 by opening switch S1 at the time of transition between the first pre-charge stage and the second pre-charge stage.

In conclusion, by combining the concepts of current boosting and subsequent voltage boosting the advantages of both concepts can be achieved, i.e. a rapid and accurate boosting scheme, while the maximum charging currents are limited to avoid cross talk. Moreover, the current boost has to be less accurate in comparison with pure current boosting, since a more accurate pre-charge signal is applied afterwards in the form of a voltage boost. Therefore, the circuitry for applying the current pre-charge signal has to fulfill less severe requirements and as a consequence the current boost source can be implemented in the display device more easily and less costly.

In FIG. 6A a second embodiment of the invention is shown. In FIG. 5A current boost source 8 was supplied with a high potential from a supply voltage $V_s$, The combined boosting circuit depicted in FIG. 6A is equivalent to the circuit depicted in FIG. 5A, except for the lead 11 connecting the current boost source 8 to the voltage source 7. This set-up can be easily implemented in an integrated circuit for driving the passive matrix display. Another advantage of this set-up is that the maximum boost current does not have to be accurately programmed in advance.

A sensing unit 10 may be employed for accurately adapting the voltage of the voltage source 7.

Figure 6B:
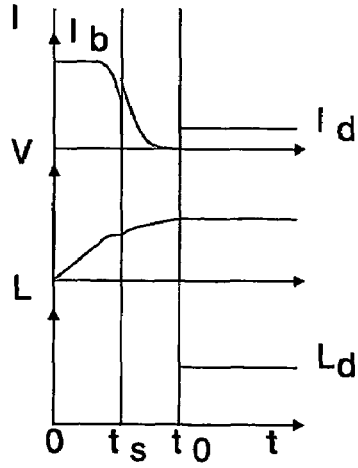

In operation, as displayed in FIG. 6B, during a first pre-charge stage starting at time t=0, a boost current $I_b$ is applied from the current boost source 8 by closing switches S1 and S5. As the current charges the associated capacitors C1 and $C_n$, the voltage V across the LED 1 increases. When the potential of point X approaches the potential supplied from voltage source 7, the current boost source 8 can no longer supply the initial boost current $I_b$. This can be seen in FIG. 6B as the current I decreases when the time t approaches time $t_s$.

At time $t=t_s$, the current I drops rapidly and the second stage is initiated. In this second stage, switch S6 closes, thereby applying a subsequent voltage boost from the voltage source 7 to LED 1. The voltage is brought accurately to the operating voltage before time $t=t_0$.

At time $t=t_0$, switches S2 and S3 are closed to operate the LED 1.

In the embodiments discussed above, limitation of the boost current $I_b$ was achieved by supplying the boost current from a current boost source 8. However, limitation of the boost current can also be achieved by using one or more resistances in combination with a voltage source. Such an embodiment is shown in FIG. 7A. In this embodiment, two resistances R1 and R2 are employed. R1 has a resistance value that is significantly larger than R2. It is appreciated that more resistors or combinations of resistors can be employed as well. The resistors can be selected by switches S7 and/or S8. Moreover it will be appreciated that the resistance may result from other components as well, such as the resistances intrinsic to the switches S7 and S8 or coils. The provision of an arrangement of resistances increases the flexibility to apply a boost current $I_b$ just below the maximum allowed current.

Figure 7B:
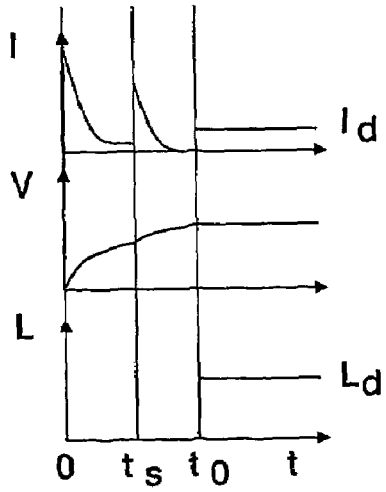

FIG. 7B illustrates the operation of the set-up shown in FIG. 7A.

At time t=0 the first pre-charge stage is started by closing switches S1 and S7. A voltage from the voltage source 7 is applied via the resistance R1 to LED 1. By using a proper value for R1, the current flowing in the display device can be limited.

At time $t=t_s$, resistance R2 is employed by closing switch S8 and the second pre-charge stage is initiated. Note that S7 may remain closed, as this decreases the overall resistance to below R2. This second stage is preferably entered while the current I in the first stage decreases rapidly, as is the case near time $t=t_s$ here.

At time $t=t_0$, switches S2 and S3 are closed to operate the LED 1.

In the embodiment of FIG. 7A two voltage boosting stages are employed via the resistances R1 and R2. The advantage of the boosting and driving circuit depicted in FIG. 7A is that no accurate current source is needed, as a result of which a very cost-effective circuit is obtained. Fast voltage boosting is obtained here in that, as the current decreases, a lower resistance is selected as a result of which during the second discharge phase a higher current is obtained for fast charging of the associated capacitors. The speed of charging is thus determined by the choice of the resistors R1 and R2. More resistor or switch sections may be added e.g. to increase flexibility.

For the purpose of teaching the invention, preferred embodiments of the display device, the pre-charging arrangement and the electronic device comprising such a display device have been described above.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A display device comprising a plurality of light emitting elements at least one of said elements having an associated capacitor, said device comprising pre-charging means for generating a pre-charge signal for at least partially charging said associated capacitor, said pre-charge signal comprising at least a first pre-charge signal in a first pre-charge stage and a second pre-charge signal in a second pre-charge stage, wherein said pre-charging means comprise a current source for generating a pre-charge current as the first pre-charge signal during said first pre-charge stage, and a voltage source for generating a subsequent pre-charge voltage subsequent to the pre-charge current as the second pre-charge signal during said second pre-charge stage.

2. The display device according to claim 1, wherein a current limiting means is provided, which is adapted to limit said pre-charge current in operation.

3. The display device according to claim 2, wherein said current limiting means is said current source.

4. The display device according to claim 2, wherein said current limiting means comprises at least one resistor arranged so as to limit said pre-charge current.

5. The display device according to claim 1, wherein said voltage source is adapted to select, in operation, at least one of said light emitting elements and said current source is connected to said voltage source so as to limit the pre-charge current.

6. The display device according to claim 1, wherein said voltage source is configured to generate a first pre-charge voltage as the first pre-charge signal during said first pre-charge stage and second pre-charge voltage as the second pre-charge signal subsequent to the first pre-charge voltage during said second pre-charge stage.

7. The diplay device according to claim 6, wherein the display device comprises means for selecting a resistance to generate said first pre-charge voltage and said subsequent second pre-charge voltage.

8. The display device according to claim 1, wherein a sensing unit is provided to obtain an operating voltage of at least one light emitting element and said voltage source is adapted to generate said subsequent pre-charge voltage in accordance with said operating voltage.

9. The display device according to claim 8, wherein said operating voltage is obtained by said sensing unit in a steady state of said light emitting element.

10. A pre-charging arrangement for pre-charging at least one capacitor associated with at least one light emitting element of a display device, said pre-charging arrangement being adapted for generating a pre-charge signal comprising at least a first pre-charge signal in a first pre-charge stage and a second pre-charge signal in a second pre-charge stage, wherein the first pre-charge signal is provided by a current source as a pre-charge current, and the second pre-charge signal is provided by a voltage source for generating a subsequent pre-charge voltage subsequent to the pre-charge current as the second pre-charge signal during the second pre-charge stage.

11. The display device of claim 1, wherein the pre-charge current has a constant amplitude which is higher than a driving current of the least one of said elements.

12. The display device of claim 11, wherein the pre-charge voltage initially increases the driving current, the driving current decreasing to less than the driving current while the pre-charge voltage is applied.

13. The display device of claim 1, wherein the pre-charge current is decreased when a threshold voltage is reached, the threshold voltage being less than an operating voltage of the least one of said elements.

14. The display device of claim 7 wherein, as the pre-charge current decreases, the means for selecting selects a lower resistance so that a higher current is obtained for faster charging.

* * * * *